United States Patent [19]

Kinoshita

[11] Patent Number: 4,715,343

[45] Date of Patent: Dec. 29, 1987

[54] METHOD AND APPARATUS FOR CONTROLLING HEATER FOR HEATING AIR-FUEL RATIO SENSOR

[75] Inventor: Yoshiaki Kinoshita, Susono, Japan

[73] Assignee: Toyota Jidosha Kabushiki Kaisha, Toyota, Japan

[21] Appl. No.: 907,819

[22] Filed: Sep. 16, 1986

[30] Foreign Application Priority Data

Sep. 17, 1985 [JP] Japan ..... 60-203407
Sep. 17, 1985 [JP] Japan ..... 60-203408
Sep. 20, 1985 [JP] Japan ..... 60-206387

[51] Int. Cl.[4] ..... F02D 41/14

[52] U.S. Cl. ..... 123/489; 123/440; 204/425

[58] Field of Search ..... 123/440, 489; 204/425

[56] References Cited

U.S. PATENT DOCUMENTS 4,182,300 1/1980 Ono et al. ..... 123/489 X
4,354,468 10/1982 Sone et al. ..... 123/489 X
4,365,604 12/1982 Sone ..... 123/440

FOREIGN PATENT DOCUMENTS 171043 10/1982 Japan ..... 123/440
87244 5/1984 Japan ..... 123/489
63455 4/1985 Japan .
202349 10/1985 Japan .
202350 10/1985 Japan .

*Primary Examiner*—Tony M. Argenbright
*Attorney, Agent, or Firm*—Cushman, Darby & Cushman

[57] ABSTRACT

In an internal combustion engine, a heater for heating an air-fuel ratio sensor provided in the exhaust gas flow passage is controlled in accordance with a parameter of a driving condition of the engine. That is the heater for the air-fuel ratio sensor is turned ON when the parameter is not larger than a predetermined value, and the heater for the air-fuel ratio sensor is turned OFF when the parameter is larger than the predetermined value. The turning ON or turning OFF of the heater is delayed with a predetermined delay time. Thus the number of times that the heater is turned ON and OFF is decreased, thereby prolonging the life of the heater.

22 Claims, 21 Drawing Figures

METHOD AND APPARATUS FOR CONTROLLING HEATER FOR HEATING AIR-FUEL RATIO SENSOR

BACKGROUND OF THE INVENTION (1) Field of the Invention

The present invention relates to a method and apparatus for controlling a heater for heating an air-fuel ratio sensor, such as an $O_2$ sensor. Such a sensor is used in an internal combustion engine for measuring the air-fuel ratio in the exhaust gas.

(2) Description of the Related Art

Generally, in a feedback control of the air-fuel ratio sensor (for example, an $O_2$ sensor) system, a base fuel amount is calculated in accordance with the detected intake air amount and detected engine speed, and the base fuel amount is corrected by an air-fuel ratio coefficient which is calculated in accordance with the output signal of an air-fuel ratio sensor for detecting the concentration of specific component such as the oxygen component in the exhaust gas. Thus, an actual fuel amount is controlled in accordance with corrected fuel amount. The above-mentioned process is repeated so that the air-fuel ratio of the engine is brought close to a stoichometric air-fuel ratio.

Note, an output signal of an oxygen-battery-type $O_2$ sensor, which shows a rich or lean air-fuel ratio, is stable when the element temperature of the $O_2$ sensor is higher than a definite value. That is, the $O_2$ sensor is in an inactive state when the element temperature thereof is lower than a definite value, and the $O_2$ sensor is in an active state when the element temperature thereof is higher than a definite value. As a result, the $O_2$ sensor has a limited application. According by, when the $O_2$ sensor is in an active state, it is possible to distinguish whether the air-fuel ratio is rich or lean, by comparing the output voltage of the $O_2$ sensor with a definite value, such as 0.45 V.

In order to keep the $O_2$ sensor in an active state, the $O_2$ sensor in which a heater is incorporated is already known. In the above mentioned $O_2$ sensor system where the $O_2$ sensor is disposed in the exhaust gas flow passage, the heater is turned ON and OFF in accordance with a driving condition parameter of the engine, such as the engine rotational speed or a load of the engine, such as the amount of intake airflow.

Nevertheless, when the heater is turned ON and OFF in accordance with the driving condition parameter of the engine, in other words, when the heater is turned ON or OFF in accordance with driving condition parameters, the heater is frequently switched from ON to OFF or vice versa, when the engine is driven at the boundary of a heater ON area and a heater OFF area determined by the driving condition parameter, or when the gear of the engine is changed. If the heater is frequently switched from ON to OFF or vice versa, so that the number of times that the heater is switched exceeds five hundred thousand within a lifetime of the engine, the wiring of the heater may be damaged beyond repair.

When the heater wire is disconnected, the air-fuel ratio control according to the output signal of the $O_2$ sensor is activated, even though the $O_2$ sensor is in an inactive condition, thus impairing the driveability, the emission characteristics, and the fuel consumption.

SUMMARY OF THE INVENTION

It is an object of the present invention to provide a method and apparatus for controlling a heater for the heating of an air-fuel ratio sensor ($O_2$ sensor) in an internal combustion engine in which the lifetime of the heater is improved.

According to the present invention, a heater for heating an air-fuel ratio sensor provided in the exhaust gas flow passage is controlled in accordance with a driving condition parameter of the engine. That is, the heater for the air-fuel ratio sensor is turned ON when the parameter is not larger than the predetermined value, and the heater for the air-fuel ratio sensor is turned OFF when the parameter is larger than the predetermined value. The turning ON or turning OFF of the heater is delayed with a predetermined delay time. Thus, the number of times that the heater is turned ON and OFF is decreased, thereby prolonging the life of the heater for the air-fuel ratio sensor.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
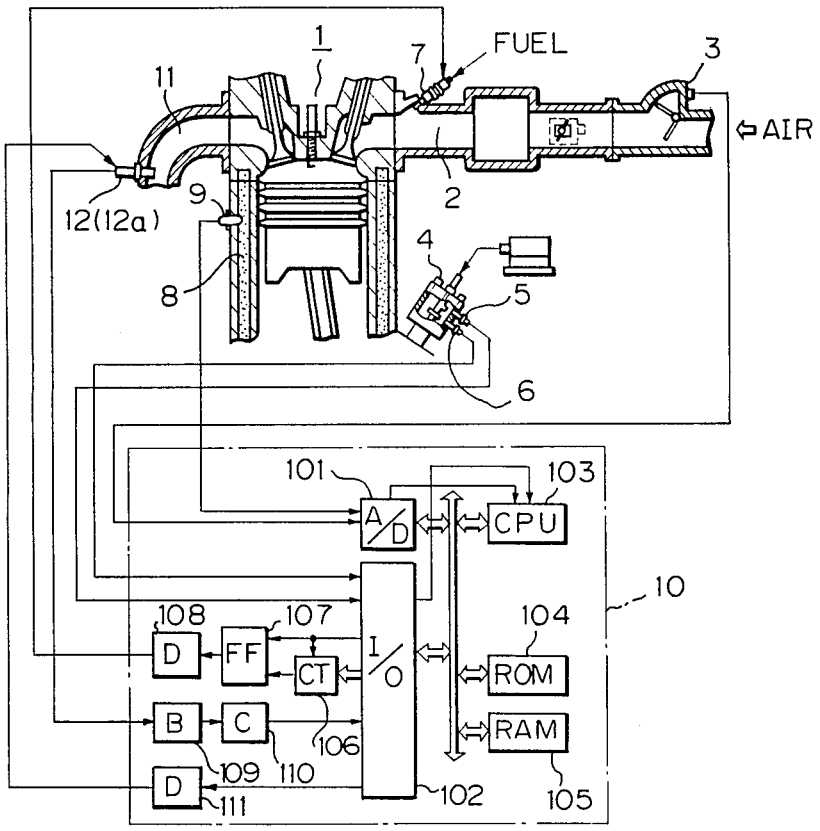
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow sensor 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crankangle sensor 4 generates a pulse signal at every 720° crank angle (CA) and the crank-angle sensor 6 generates a pulse signal at every 30° CA. The pulse signals of the crank sensors 5 and 6 are supplied to an input/output (I/O) 102 interface of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, not shown in FIG. 1.

Disposed in a cylinder block 13 of the engine 1 is a coolant temperature sensor 9 for detecting the temperature of the coolant 8. The coolant temperature sensor 9 generates an analog voltage signal in response to the temperature of the coolant and transmits it to the A/D converter 101 of the control circuit 10.

Provided in an exhaust gas passage 11 of the engine 1 is a $O_2$ sensor 12 for detecting the concentration of oxygen composition in the exhaust gas. The $O_2$ sensor 12 has a heater **12*a* (not shown) and a sensor element, and the heater warms the element when the temperature of the exhaust gas is low. The $O_2$ sensor 12 generates an output voltage signal and transmits it to the A/D converter 101 of the control circuit 10. The current control of the heater 12*a* is activated by the driver circuit of the control circuit 10**.

The control circuit 10, which may be constructed by a microcomputer, further comprises a read-only memory (ROM) 104 for storing a main routine, interrupt routines such as a fuel injection routine, an ignition timing routine, tables (maps), constants, etc., a random access memory 105 (RAM) for storing temporary data, a down counter 106, a flip-flop 107, a driver circuit 108, a buffer circuit 109, a comparison circuit 110, and the like.

The down counter 106, the flip-flop 107, and the driver circuit 108 are used for controlling the fuel injection amount TAU calculated in a TAU routine, the amount TAU is preset in the down counter 106, and simultaneously, the flip-flop 107 is set. As a result, the driver circuit 108 initiates the activation of the fuel injection valve 7. On the other hand, the down counter 106 counts up the clock signal from the clock generator (not shown), and finally generates a logic "1" signal from the carry-out terminal thereof, to reset the flip-flop 107, so that the driver circuit 108 stops the activation of the fuel injection valve 7. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal, and when the clock generator generates a special clock signal.

The intake air amount data Q of the airflow sensor 3 is fetched by an A/D conversion routine(s) executed at every predetermined time period and is then stored in the RAM 105. That is, the data Q in the RAM 105 is renewed at every predetermined time period. The engine speed Ne is calculated by an interrupt routine executed at 30° CA, i.e., at every pulse signal of the crank angle sensor 6, and is then stored in the RAM 105.

Figure 2:
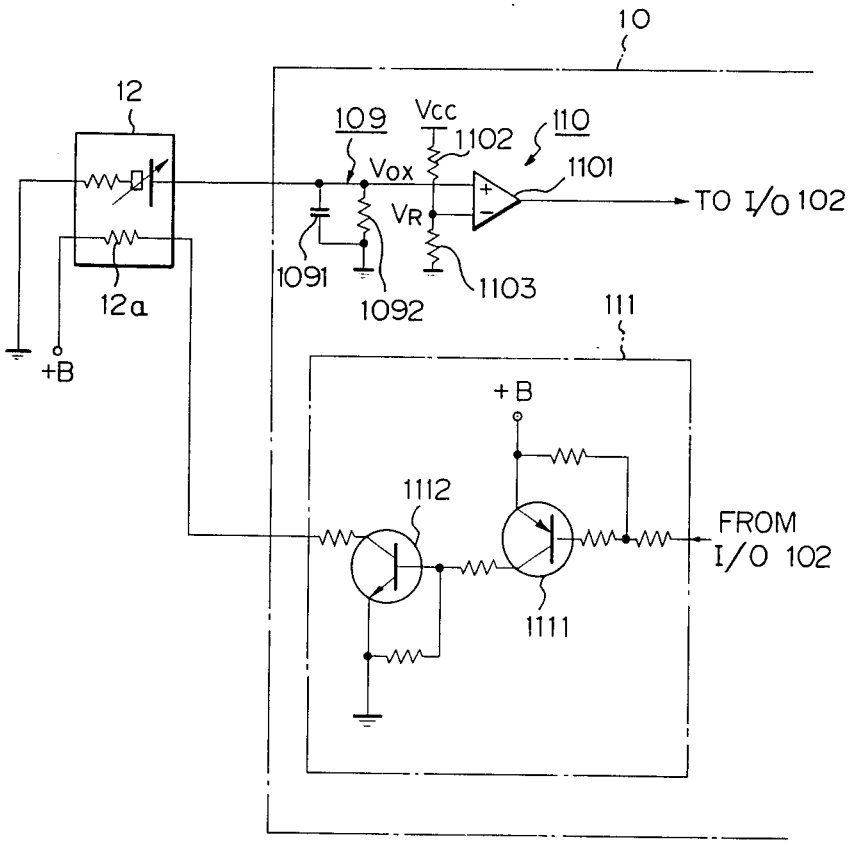
FIG. 2 is a detailed circuit diagram showing a part of control circuit of FIG. 1.

FIG. 2 shows a part of the control circuit 10 and the $O_2$ sensor of FIG. 1. A buffer circuit 109 includes a capacitor 1091 and a resistor 1092, and a comparison circuit 110 includes an operational amplifier 1101 and resistors 1102 and 1103, and generates a reference voltage VR (=0.45 V) and transmits it to an inverted input of the operational amplifier 1101. The resistor 1092 is used for limiting the maximum output level of the $O_2$ sensor 12 when the temperature of the element of the $O_2$ sensor is too high.

That is, an output signal of the $O_2$ sensor 12 is once stored in the buffer circuit 109, and is then converted into a digital signal by the comparison circuit 110. This digital signal is transmitted to an I/O interface 102 for an air-fuel ratio feedback control. Note that Vcc indicates an supply voltage of control circuit 10, for example, 5 V.

A driver circuit 111 consists of serially-connected transistors 1111 and 1112. Reference +B is a battery voltage such as 12 V. When the output signal of the I/O interface 102 is low, the power transistors 1111 and 1112 are both turned ON and the heater **12*a* is turned ON. On the other hand, when the output signal of the I/O interface 102 is high, the power transistors 1111 and 1112 are turned OFF and the heater 12*a*** turned OFF.

Figure 3:
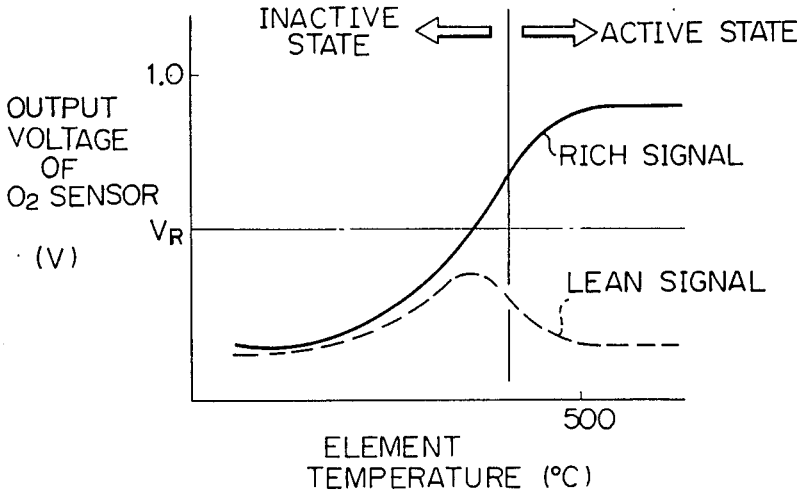
FIG. 3 to FIG. 6 are graphs explaining the principle of the present invention.

FIG. 3 shows the relationship between the output voltage and the element temperature of the $O_2$ sensor 12. When the air-fuel ratio is rich, a rich signal from the $O_2$ sensor increases in accordance with the element temperature of the $O_2$ sensor, to become stable at a high level. On the other hand, when air-fuel ratio is lean, a lean signal from the $O_2$ sensor once increases in accordance with the element temperature of the $O_2$ sensor, but decreases in accordance with the decrease of the element temperature of the $O_2$ sensor 12 to become stable at a low level. That is, the $O_2$ sensor comes to an active state or an inactive state in accordance with its element temperature, and accordingly, the operation range of the $O_2$ sensor 12 is limited.

Figure 4:
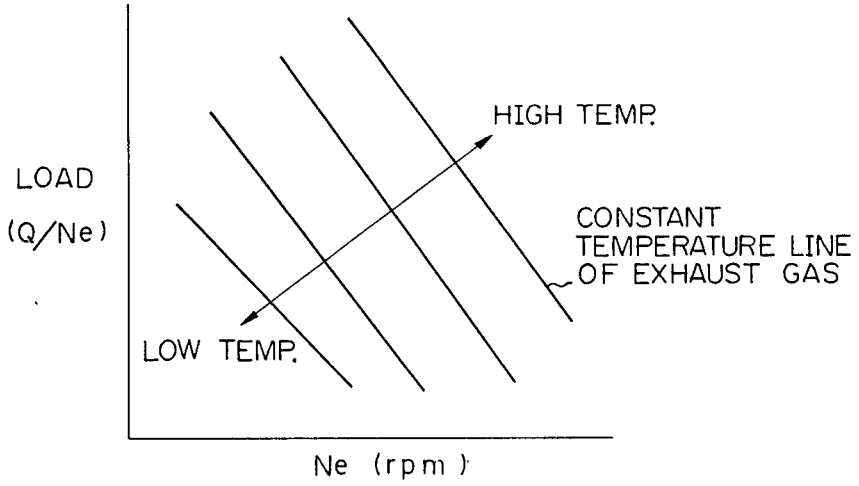

FIG. 4 shows the temperature of the exhaust gas in relation to an engine rotational speed Ne and a load such as an intake air amount Q/Ne per one engine revolution. Note that the temperature of the exhaust gas of the engine almost corresponds to the temperature of the $O_2$ sensor element.

Figure 5:
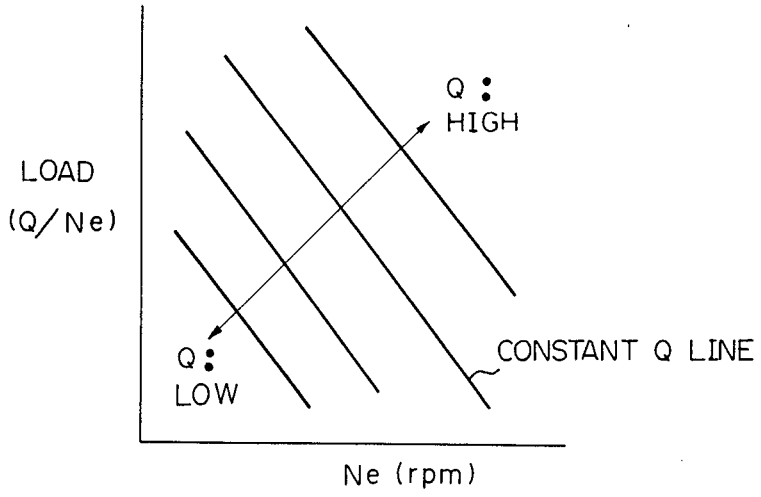

On the other hand, FIG. 5 shows the intake air amount in relation to the engine rotational speed Ne and the load Q/Ne. As shown in FIGS. 4 and FIG. 5, the temperature of the exhaust gas depends on the intake air amount, therefore it can be understood that the temperature of the $O_2$ sensor element also depends on the amount of intake air.

Figure 6:
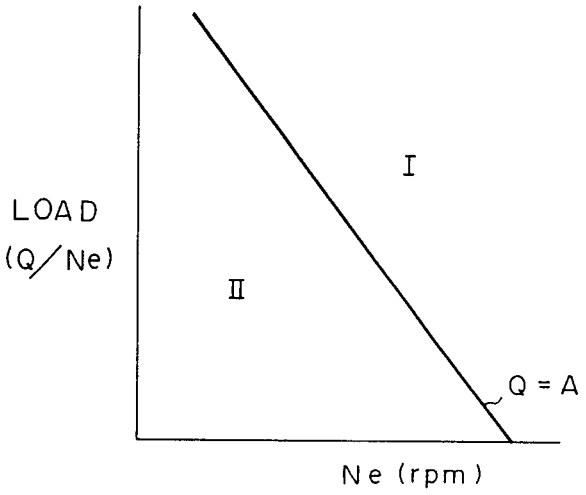

In the present invention, the temperature of the $O_2$ sensor element is indirectly detected by the intake air amount Q. As shown in FIG. 6, a heater OFF area I and a heater ON area II are divided by a line at which Q=A. When the intake air amount Q is in the area II, the heater **12*a* is turned ON. On the other hand, when the intake air amount Q is in the area I, the heater 12*a* is turned OFF. When the intake air amount Q changes from the area II to the area I, the heater 12*a* is turned OFF with a delay time, and when the intake air amount Q changes from the area I to the area II, the heater 12*a*** is turned ON with a delay time.

The operation of the control circuit 10 of FIG. 1 will be explained with reference to the flowcharts of FIGS. 7A, 7B, 10, 12A, and 12B.

Figure 7A:
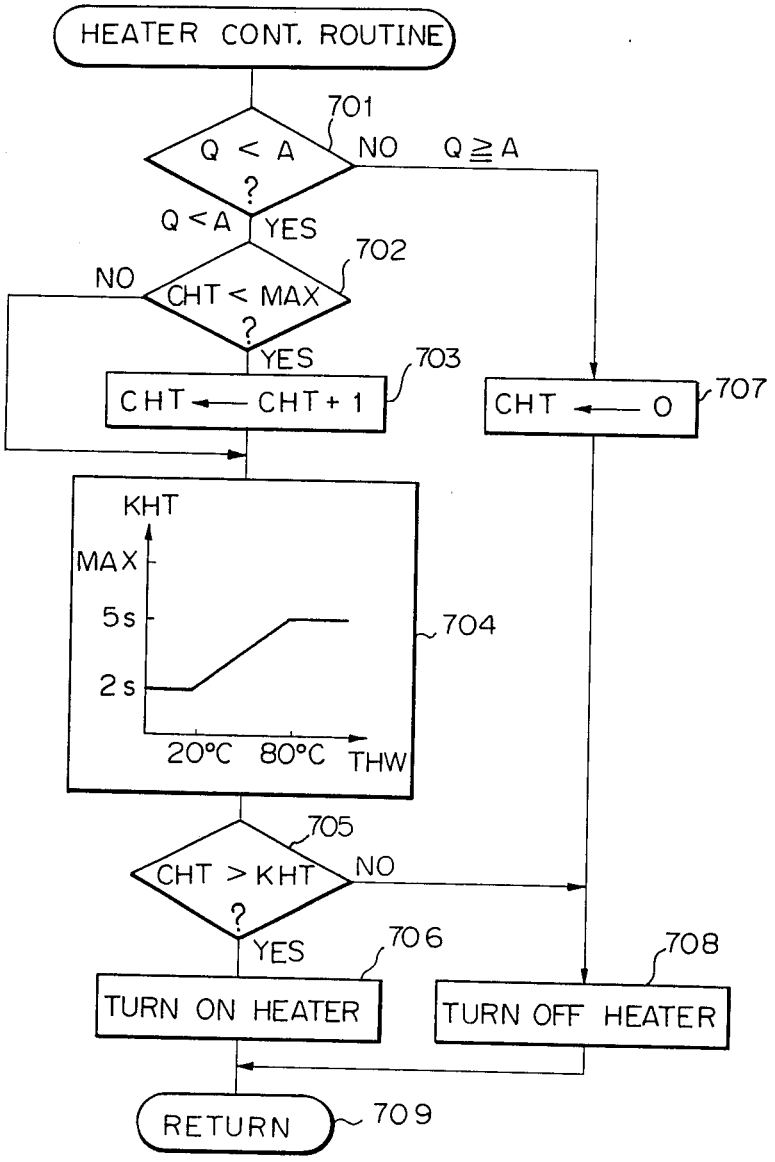
FIGS. 7A, 7B, 10, 12A, and 12B are flowcharts showing the operation of the control circuit of FIG. 1; and, FIGS. 8A, 8B, 8C, 9A, 9B, 9C, 11, 13A, 13B, and 13C are waveforms explaining the flowcharts of FIGS. 7A, 7B, 10, 12A, and 12B.

FIG. 7A is a routine for controlling the heater **12*a* executed at every predetermined time period such as 4 ms. In this routine, the heater 12*a* is not turned ON even when the intake air amount Q is in the heater turn ON area II. That is, the heater 12*a*** is turned ON when a predetermined delay time has passed after the change of the intake air amount Q from the heater turn OFF area I to heater turn ON area II.

At step 701, the data of the intake air amount Q is read from the RAM 105, and it is determined whether or not the intake air amount Q is smaller than a predetermined value A. Note that the value A is constant or changeable in accordance with a driving condition parameter of the engine. If Q<A (heater is in the turn ON area II), the control proceeds to step 702 which determines whether or not the value of a delay counter CHT is smaller than a maximum value MAX thereof. If CHT≧MAX (NO), the control proceeds to step 704, but if CHT<MAX (YES), the control proceeds to step 703, which increases the delay counter CHT by 1. Then the control proceeds to step 704.

At step 704, the delay time KHT is calculated from a one dimensional map stored in the ROM 104 by using the coolant temperature data THW stored in the RAM 105. Note that the delay time KHT is short when the coolant temperature THW is low, and the delay time KHT is long when the coolant temperature THW is high, as shown in FIG. 7A. The ordinate line of the map within the block at step 704 indicates time. Then, at step 705, it is determined whether or not the delay counter CHT is larger than the delay time KHT. If CHT≦KHT (NO), the control proceeds to step 708 which causes the input of the driver circuit 111 to be high to turn OFF the power transistors 1111 and 1112. Thus, the heater 12*a* is turned OFF. On the other hand if CHT>KHT (YES), the control proceeds to step 706 which causes the input of the driver circuit 111 to be low to turn ON the power transistors 1111 and 1112. Thus, the heater 12*a* is turned ON. If Q≧A (NO) at step 701, the control proceeds to step 707 which resets the delay counter CHT. Then the control proceeds to step 708 which turns OFF the heater 12*a*. The routine is completed at step 709.

In this way, when the detected intake air amount Q is changed from the heater turn OFF area I to the heater turn ON area II, the heater 12*a* is turned ON only after the delay time KHT has passed. Note that the delay time KHT is changeable according to the coolant temperature THW. Thus, when the engine is in a warming-up condition and the coolant temperature THW is low, the heater 12*a* is promptly turned ON, thereby shortening the warming-up time of the heater element. When the warming-up of the engine is finished and the coolant temperature THW is high, the heater 12*a* is turned ON with a relatively long delay time.

In this above mentioned control system, although the intake air amount Q is used as a driving condition parameter, other parameters such as the intake air amount per one revolution Q/Ne, the engine rotational speed Ne, the coolant temperature THW, the ON/OFF signal of the starter, the opening angle of the throttle valve, are used individually or in combination. Also, the delay time KHT can be changed in accordance with the speed of the automotive vehicle.

Figures 8A, 8B, 8C:
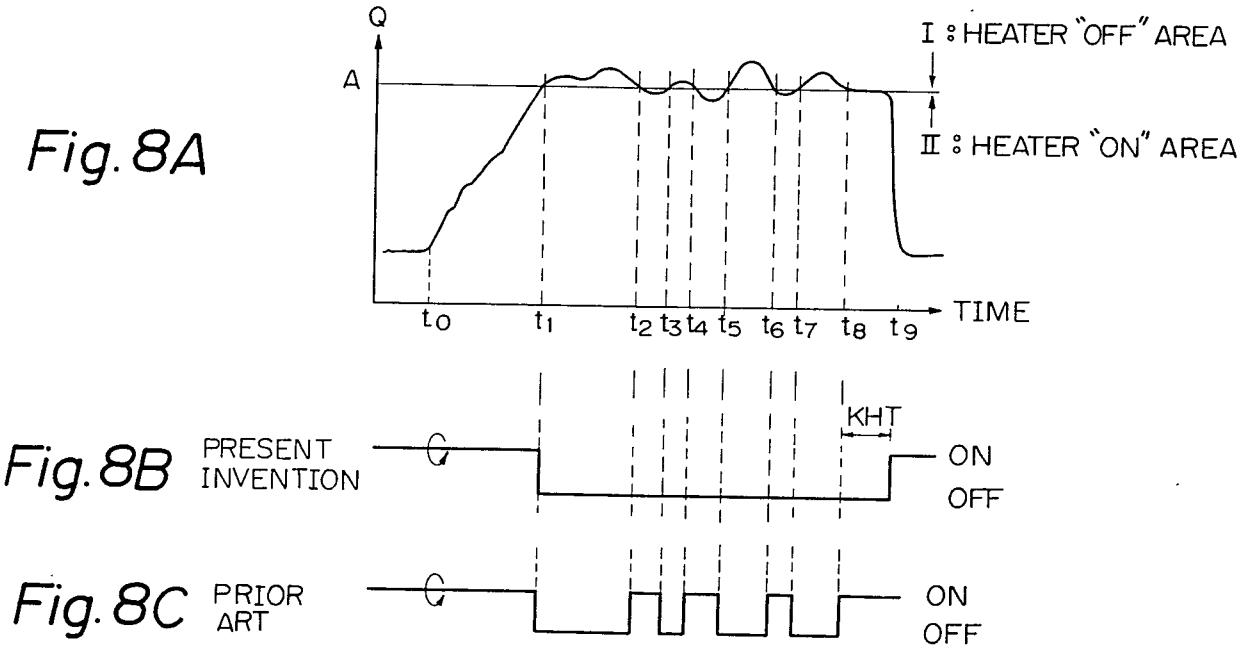

The flowchart of FIG. 7A will be explained in more detail with reference to FIGS. 8A, 8B, and 8C. FIG. 8A shows the change of the intake air amount Q in accordance with the driving condition of the automotive vehicle. In FIG. 8A, the automotive vehicle starts at time $t_0$, and at time $t_1$ to $t_9$, the automotive vehicle is in an acceleration and deceleration state under a high load condition. Also at time $t_1$, $t_3$, $t_5$, or $t_7$, the intake air amount Q exceeds A, and at time $t_2$, $t_4$, $t_6$ or $t_7$, the intake air amount Q becomes lower than A. Further, every time interval of time $t_2$ to $t_3$, $t_4$ to $t_5$, and $t_6$ to $t_7$ is shorter than the delay time KHT.

In the prior art, according to the driving condition of FIG. 8A, the heater 12*a* is frequently repeated turned ON and turned OFF from time $t_1$ to $t_9$, as shown in FIG. 8C. Contrary to this, in the present invention, the heater 12*a* is kept OFF from time $t_1$ to $t_9$, as shown in FIG. 8B. Thus, according to the present invention, the number of times that the heater 12*a* is turned ON and OFF is remarkably decreased. As a result, the time period when the heater is turned OFF can be prolonged, thus decreasing the load on the alternator of the engine, when generates current, and the fuel consumption. That is, both good warming-up characteristics and a high durability of the $O_2$ sensor can be obtained.

Figure 7B:
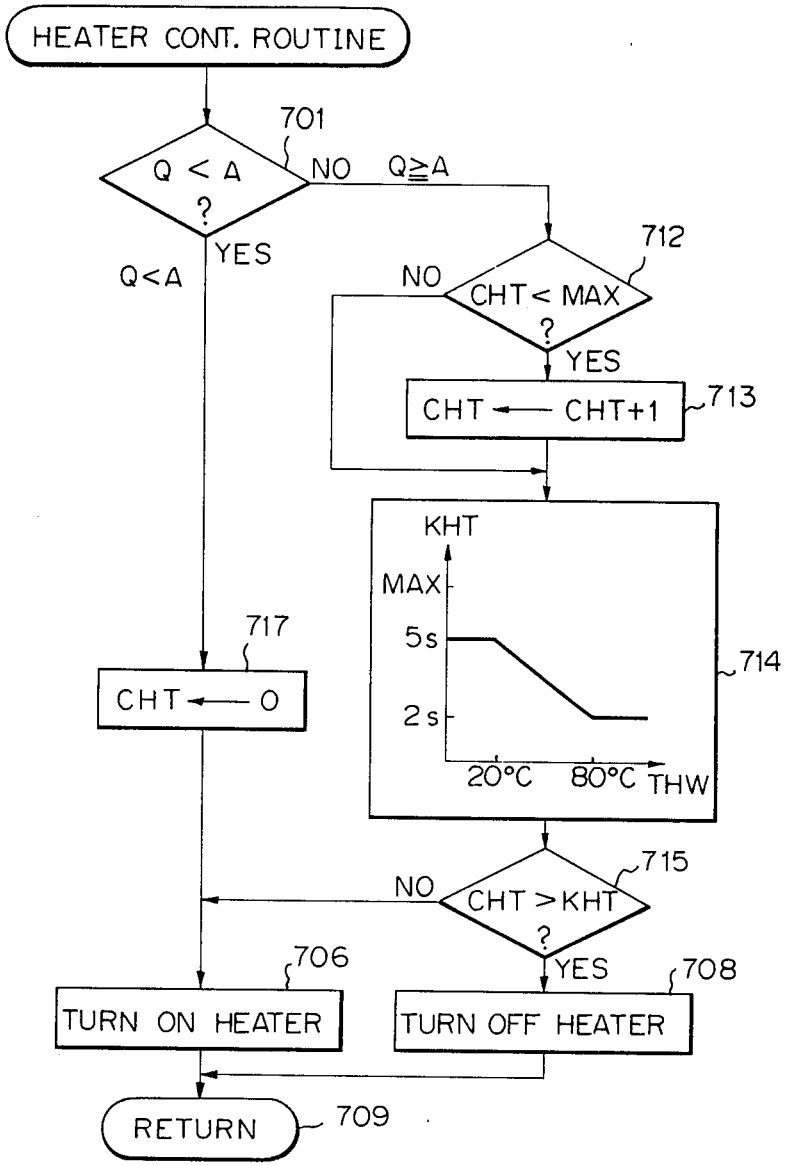

FIG. 7B is a routine for controlling the heater 12*a* executed at every predetermined time period such as 4 ms. In this routine, the heater 12*a* is not turned OFF even when the intake air amount Q is in the heater turn OFF area I. That is, the heater 12*a* is turned OFF when a predetermined delay time has passed after the change of the intake air amount Q from the heater turn ON area II to the heater turn OFF area I.

At step 701, the data of the intake air amount Q is read from the RAM 105, and it is determined whether or not the intake air amount Q is smaller than a predetermined value A. Note that the value A is constant or changeable in accordance with a driving condition parameter of the engine. If Q≧A (heater is in the turn OFF area I), the control proceeds to step 712, which determines whether or not the value of a delay counter CHT is smaller than its maximum value MAX. If CHT≧MAX (NO), the control proceeds to step 714, but if CHT<MAX (YES), the control proceeds to step 713, which increases the delay counter CHT by 1. Then the control proceeds to step 714.

At step 714, the delay time KHT is calculated from a one dimensional map stored in the ROM 104 by using the coolant temperature data THW stored in the RAM 105. Note that the delay time KHT is long when the coolant temperature THW is low, and the delay time KHT is short when the coolant temperature THW is high as shown in FIG. 7B. The ordinate line of the map within the block at step 714 indicates time. Then at step 715, it is determined whether or not the delay counter CHT is larger than the delay time KHT. If CHT≦KHT (NO), the control proceeds to step 706 which causes the input of the driver circuit 111 to be low, to turn ON the power transistors 1111 and 1112. Thus, the heater 12*a* is turned ON. On the other hand, if CHT>KHT (YES), the control proceeds to step 708, which causes the input of the driver circuit 111 to be low to turn ON the power transistors 1111 and 1112. Thus, the heater 12*a* is turned OFF. If Q<A (YES) at step 701, the control proceeds to step 717 which resets the delay counter CHT. Then the control proceeds to step 706 which turns ON the heater 12*a*. This routine is completed at step 709.

In this way, when the detected intake air amount Q is changed from the heater turn ON area II to the heater turn OFF area I, the heater 12*a* is turned OFF only after the delay time KHT has passed. Note that the delay time KHT is changeable according to the coolant temperature THW. Thus, when the engine is in a warming-up condition and the coolant temperature THW is low, the heater 12*a* is turned OFF with a relatively long delay time, thereby shortening the warming-up time of the heater element. When the warming-up of the engine is finished and the coolant temperature THW is high, the heater 12*a* is promptly turned OFF.

In this above mentioned control system, although the intake air amount Q is used as a driving condition parameter, other parameters such as intake air amount per one revolution Q/Ne, the engine rotational speed Ne, the coolant temperature THW ON/OFF signal of the starter, the opening angle of the throttle valve, are used individually or in combination. Also, the delay time KHT can be changed in accordance with the speed of the automotive vehicle.

Figures 9A, 9B, 9C:
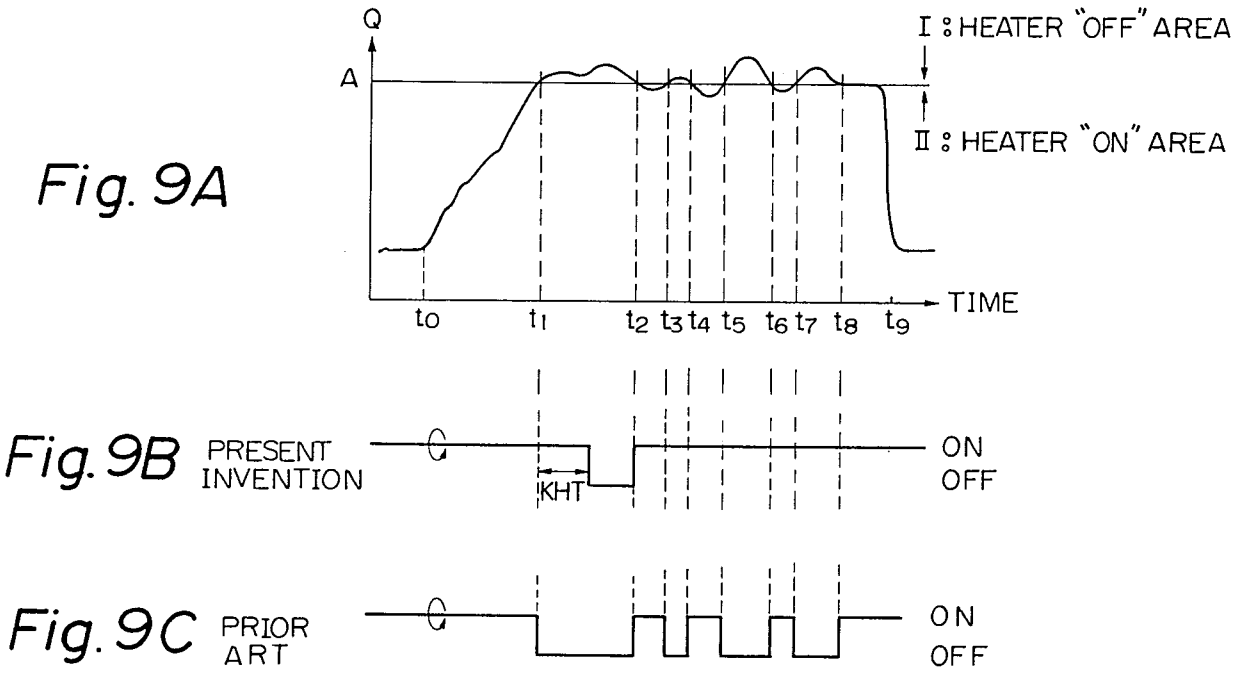

The flowchart of FIG. 7B will be explained in more detail with reference to FIGS. 9A, 9B, and 9C. FIG. 9A shows the change of the intake air amount Q in accordance with the driving condition of the automotive vehicle. In FIG. 9A, the automotive vehicle starts at time $t_0$, and at time $t_1$ to $t_9$, the automotive vehicle is in an acceleration and deceleration state under a high load condition. Also, at time $t_1$, $t_3$, $t_5$, or $t_7$, the intake air amount Q exceeds A, and at time $t_2$, $t_4$, $t_6$ or $t_7$, the intake air amount Q becomes lower than A. Further, every time interval of time $t_2$ to $t_3$, $t_4$ to $t_5$, and $t_6$ to $t_7$ is shorter than the delay time KHT.

In the prior art, according to the driving condition of FIG. 9A, the heater 12a is repeatedly turned ON and turned OFF from time $t_1$ to $t_9$, as shown in FIG. 9C. Contrary to this, in the present invention, the heater 12a is only turned OFF for a short time from time $t_1$ to $t_2$, as shown in FIG. 9B. Thus according to the present invention, the number of times that the heater 12a is turned ON and OFF is remarkably decreased. As a result, the time period when the heater is turned OFF can be prolonged, and thus both good warming characteristics and a high durability of the $O_2$ sensor can be obtained.

Figure 10:
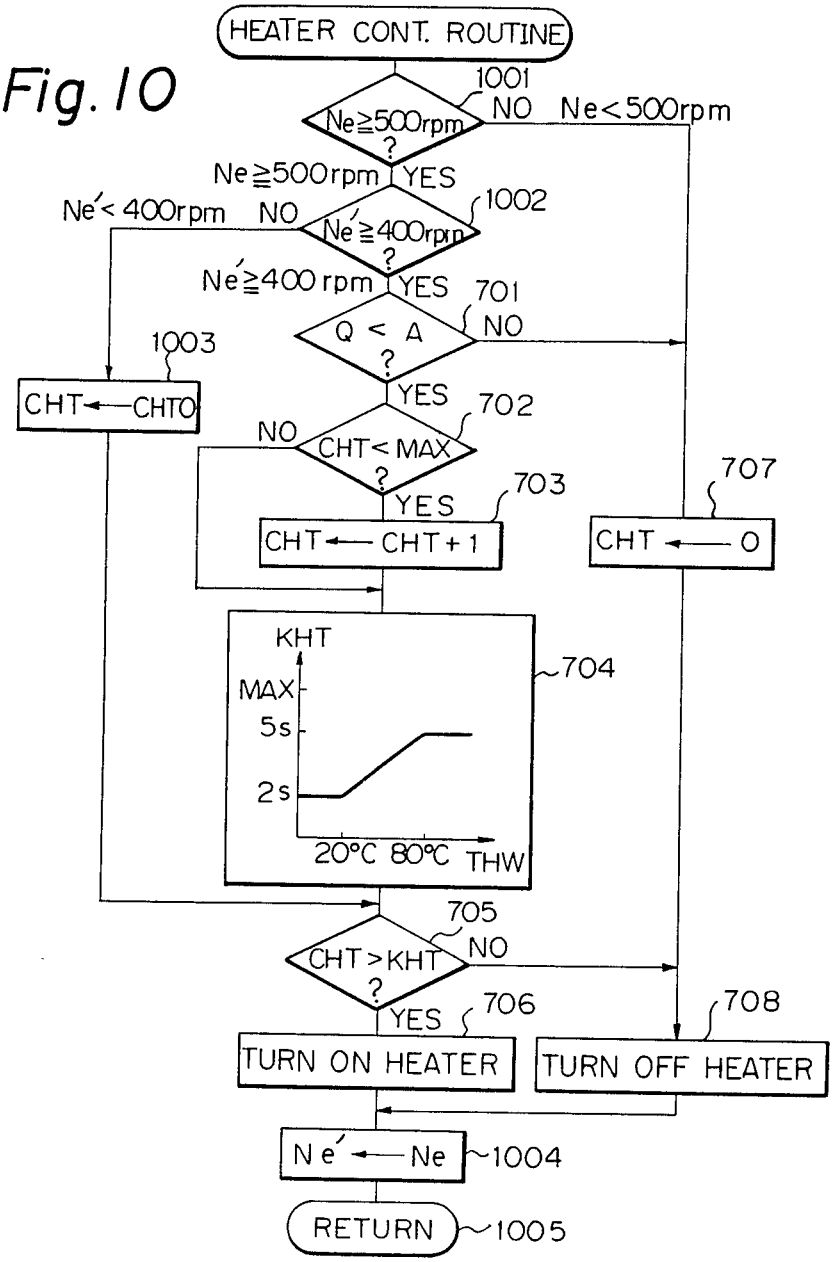

Further operation of the control circuit 10 will be explained with reference to FIG. 10. FIG. 10 is a modification of the flowcharts shown in FIG. 7A, also executed at every 4 ms. In FIG. 10, steps 1001 to 1004 are added to steps 701 to 708 of FIG. 7A.

At step 1001, it is determined whether or not the engine rotational speed Ne is larger than a predetermined speed, such as 500 rpm. If the engine rotational speed Ne is less than 500 rpm (NO), the control proceeds to steps 707 and 708, already discussed in FIG. 7A. Contrary to this, if the engine rotational speed Ne is larger than 500 rpm (YES), the control proceeds to step 1002. At step 1002, it is determined whether or not the engine rotational speed Ne', calculated at a previous execution of this routine, is larger than a predetermined speed such as 400 rpm. If the engine rotational speed Ne' is larger than 400 rpm (YES), the control proceeds to step 701, already discussed in FIG. 7A. Contrary to this, if the engine rotational speed Ne is less than 400 rpm (NO), the control proceeds to step 1003.

At step 1003, a definite value CHT0 is set in the delay counter CHT. Then the control proceeds to step 705, already discussed in FIG. 7A. The value CHT0 is used for shortening the delay time KHT for turning ON the heater 12a. If the value CHT is larger than the delay time KHT, the delay time is substantially 0, because CHT>KHT is always realized at step 705.

After the heater 12a is turned ON at step 706 or turned OFF at step 708, the control proceeds to step 1004. At step 1004, the engine rotational speed Ne is stored in the RAM 105 as an engine rotational speed Ne' in order to prepare the next execution of the heater control routine.

Figure 11:
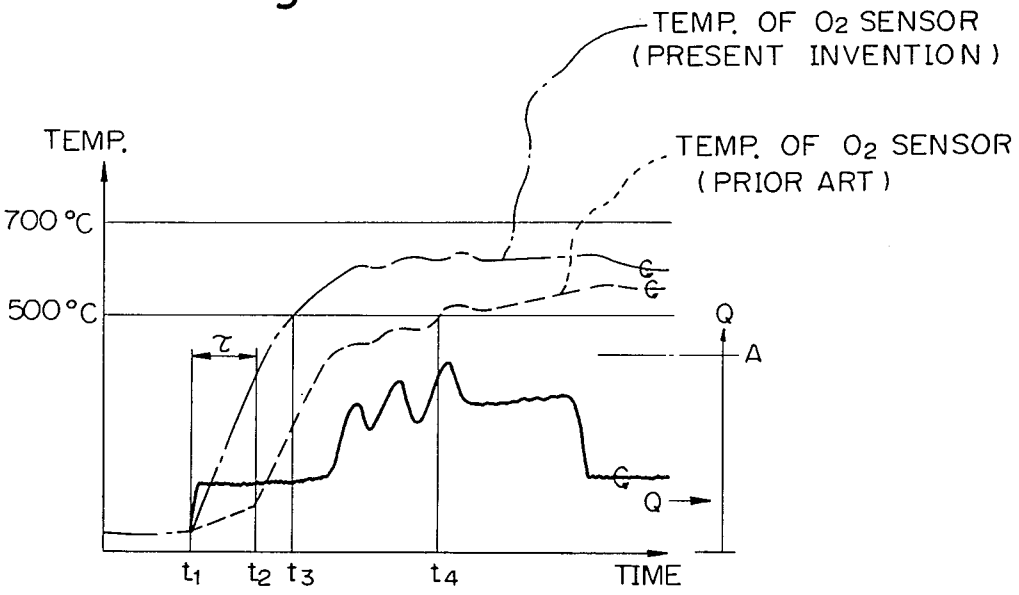

The flowcharts of FIG. 10 will be explained in more detail with reference to FIG. 11, a solid line shows the intake air amount Q which is changed in accordance with the driving condition of the automotive vehicle, whose engine is started at time $t_1$. Just after time $t_1$, the intake air amount Q is lower than A, so that the heater 12a is in an ON condition. In FIG. 10, the heater 12a is turned ON immediately after the engine is started. As a result, the temperature of the $O_2$ sensor 12 is increased quickly, as indicated by a solid line in FIG. 11. Thus, the temperature of the $O_2$ sensor 12 exceeds 500° C. at time $t_3$. This is helpful in starting the engine. Contrary to this, if there is the delay time KHT before the heater 12a is turned ON, the temperature of the $O_2$ sensor 12 is increased as indicated by a dotted line in FIG. 11. In this case, the temperature of the $O_2$ sensor 12 does not exceed 500° C. until time $t_4$. Therefore, according to the routine of FIG. 10, the drivability, the emission, and the fuel consumption can be improved.

Figure 12A:
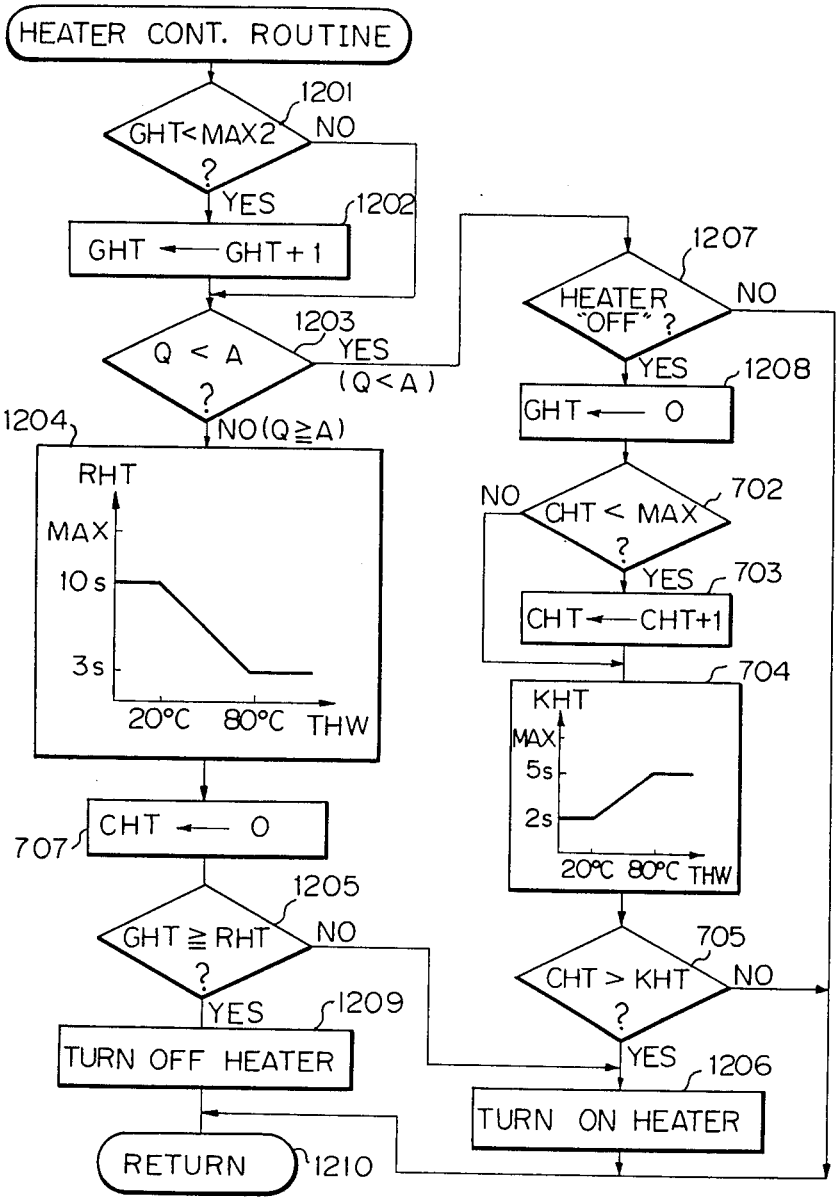
Figure 12B:
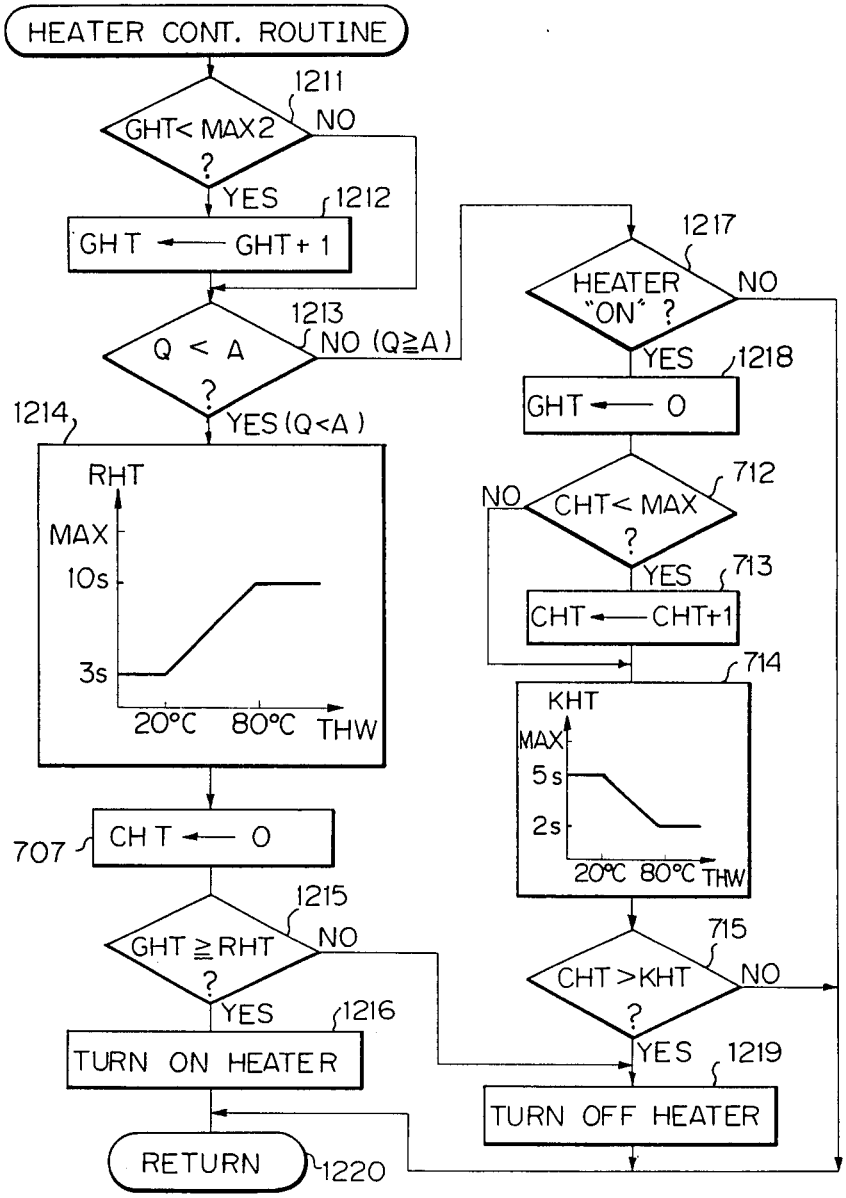

FIGS. 12A, 12B show further operations of the control circuit 10 also executed by 4 ms. In these operations, the delay time KHT is calculated in the same way as explained above at steps 702 to 705 in FIG. 7A and with steps 712 to 715 in FIG. 7B.

In FIG. 12A, at step 1201, it is determined whether or not a counter GHT is smaller than its maximum value MAX2. If GHT<MAX2 (YES), the control proceeds to step 1202 which increases the counter GHT by 1, and then the control proceeds to step 1203. But if GHT≧MAX2 (NO), the control proceeds to step 1203 without increasing the counter GHT. Note that the counter GHT is used for counting a time duration after the change of the heater 12a from a turn ON condition to a turn OFF condition. At step 1203, the intake air amount Q is read from the RAM 105 and it is determined whether or not the intake air amount Q is smaller than a predetermined value A. Note that the value A is constant or changeable in accordance with a driving condition parameter of the engine. If Q≧A (NO), the control proceeds to step 1204.

At step 1204, a reference time RHT is calculated from a one-dimensional map stored in the ROM 104 by using the coolant temperature data THW stored in the RAM 105. Note that the delay time RHT is long when the coolant temperature THW is low, and the reference time RHT is short when the coolant temperature THW is high, as shown in the block in step 1204. The ordinate line of the map within the block at step 1204 indicates time. Then at step 707, a delay counter CHT is reset and the control proceeds to step 1205, which determines whether or not the counter GHT is larger than the reference time RHT. If GHT≧RHT (YES), the control proceeds to step 1209, which causes the input of the driver circuit 111 to be high to turn OFF the power transistors 1111 and 1112. Thus, the heater 12a is turned OFF. On the other hand, if GHT<RHT (NO), the control proceeds to step 1206 which causes the input of the driver circuit 111 to be low to turn ON the power transistors 1111 and 1112. Thus, the heater 12a is turned ON.

If Q<A (YES) at step 1203, the control proceeds to step 1207 which determines whether or not the heater 12a is in the OFF condition. If the heater 12a is turned ON (NO), the control proceeds to step 1210, thus completing this routine. But if the heater 12a is turned OFF (YES), the control proceeds to step 1208 which resets the counter GHT. Then the control proceeds to step 702. Steps 702 to 705 are used for delaying the turning ON of the heater 12a, as already explained in FIG. 7A. That is, by the control of steps 702 to 705, the heater 12a is turned ON with a delay time CHT. After steps 702 to 705, the control proceeds to step 1206 which turns ON the heater 12a. This routine is completed at step 1210.

In FIG. 12B, at step 1211, it is determined whether or not a counter GHT is smaller than its maximum value MAX2. If GHT<MAX2 (YES), the control proceeds to step 1212 which increases the counter GHT by 1, and then the control proceeds to step 1213. But if GHT≧MAX2 (NO), the control proceeds to step 1213 without increasing the counter GHT. Note that the counter GHT is used for counting a time duration after the change of the heater 12a from a turn OFF condition to a turn ON condition. At step 1213, the intake air amount Q is read from the RAM 105 and it is determined whether or not the intake air amount Q is smaller than a predetermined value A. Note that the value A is constant or changeable in accordance with a driving condition parameter of the engine. If Q<A (YES), the control proceeds to step 1214.

After step 1214, a reference time RHT is calculated from a one-dimensional map stored in the ROM 104 by using the coolant temperature data THW stored in the RAM 105. Note that the delay time RHT is short when the coolant temperature THW is low, and the reference time RHT is long when the coolant temperature THW is high, as shown in the block in step 1214. The ordinate line of the map within the block at step 1214 indicates time. Then at step 707, a delay counter CHT is reset and the control proceeds to step 1215, which determines whether or not the counter GHT is larger than the reference time RHT. If GHT≧RHT (YES), the control proceeds to step 1216 which turns ON the heater 12a. On the other hand, if GHT<RHT (NO), the control proceeds to step 1219 which turn OFF the heater 12a.

If Q<A (NO) at step 1213, the control proceeds to step 1217 which determines whether or not the heater 12a is in an ON condition. If the heater 12a is turned OFF (NO), the control proceeds to step 1220, thus completing this routine. But if the heater 12a is turned ON (YES), the control proceeds to step 1218 which resets the counter GHT. Then the control proceeds to step 712. Steps 712 to 715 are used for delaying the turning OFF of the heater 12a, as already explained in FIG. 7B. That is, by the control of steps 712 to 715, the heater 12a is turned OFF with a delay time CHT. After steps 712 to 715, the control proceeds to step 1219 which turns OFF the heater 12a. This routine is completed at step 1220.

Figure 13A:
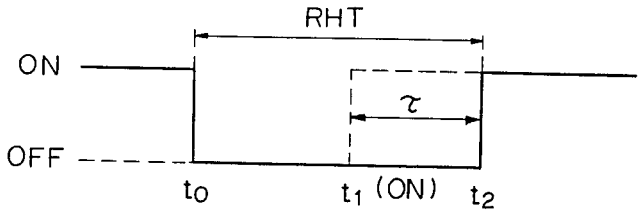
Figure 13B:
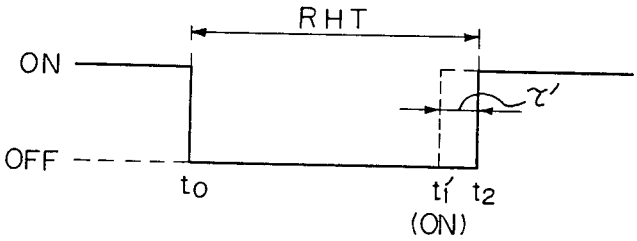
Figure 13C:
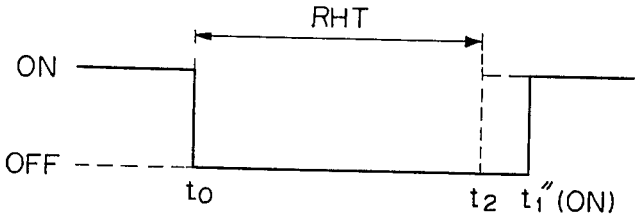

The operation of FIG. 12B will be explained in more detail with reference to FIGS. 13A to 13C. In FIG. 13A, the heater 12a is turned OFF at time $t_0$. Then the heater ON condition (Q<A) is completed at time $t_1$, but the heater 12a does not turn ON until the reference time RHT has passed at time $t_2$. That is, there is a delay time of $\tau$ $(t_2-t_1)$ before the heater 12a is turned ON. In FIG. 13B, the heater 12a is turned OFF at time $t_0$. Then the heater ON condition (Q<A) is completed at time $t_1'$ when a relatively long time has passed since time $t_1$, but time $t_1'$ is still before time $t_2$. Also in this case, the heater 12a turns ON at time $t_2$ with a short delay time of $\tau'$ $(RHT-(t_1'-t_0))$. In FIG. 13C, the heater 12a is turned OFF at time $t_0$, and then the heater ON condition (Q<A) is completed at time $t_1''$ when the reference time RHT has already passed. In this case, the heater 12a turns ON at time $t_1''$ without any delay time.

Thus, the number of times that the heater 12a is turned ON and OFF is decreased in addition to the decrement of the number by the delay time CHT as explained in FIG. 7B. The operation of the flowchart shown in FIG. 12A is almost the same as explained above with reference to FIGS. 13A, 13B, and 13C. Thus, according to the present invention, the number of times that the heater 12a is turned ON and OFF is remarkably decreased. As a result, the time period when the heater is turned OFF or ON can be prolonged, and thus both the warming characteristics and the durability of the $O_2$ sensor 12 can be improved.

I claim:

1. A method for controlling a heater for heating an air-fuel ratio sensor provided in an exhaust gas flow passage of an internal combustion engine comprising the steps of:

detecting a driving condition parameter of said engine;

determining whether or not said parameter is larger than a predetermined value;

turning ON said heater when said parameter is not larger than said predetermined value;

turning OFF said heater when said parameter is larger than said predetermined value; and, delaying the turning ON of said heater with a predetermined delay time when said parameter is not larger than said predetermined value.

2. A method as set forth in claim 1, further comprising the steps of:

determining whether or not said engine is in a starting condition; and, decreasing said delay time immediately after said engine becomes in said starting condition.

3. A method as set forth in claim 1, further comprising the steps of:

measuring a duration at which said heater is turned ON;

determining whether or not said duration is longer than the predetermined time period;

turning OFF said heater when said parameter is larger than said predetermined value and said duration is longer than said predetermined time period.

4. A method as set forth in claim 1, further comprising the steps of:

changing said delay time in accordance with said driving condition parameter of said engine and a speed of a vehicle on which said engine is mounted.

5. A method as set forth in claim 1, wherein said driving condition parameter of said engine is an intake air amount.

6. A method as set forth in claim 2, wherein said delay time is 0.

7. A method as set forth in claim 2, further comprising a step of judging whether or not an engine rotational speed is larger than a predetermined speed, thereby determining that said engine is in said starting condition.

8. A method for controlling a heater for heating an air-fuel ratio sensor provided in an exhaust gas flow passage of an internal combustion engine comprising the steps of:

detecting a driving condition parameter of said engine;

determining whether or not said parameter is larger than a predetermined value;

turning ON said heater when said parameter is not larger than said predetermined value;

turning OFF said heater when said parameter is larger than said predetermined value; and, delaying the turning OFF of said heater with a predetermined delay time when said parameter is larger than said predetermined value.

9. A method as set forth in claim 8, further comprising the steps of:

measuring a duration at which said heater is turned OFF:

determining whether or not said duration is longer than a predetermined time period;

turning ON said heater when said parameter is larger than said predetermined value and said duration is longer than said predetermined time period.

10. A method as set forth in claim 8, further comprising the steps of:

changing said delay time in accordance with said driving condition parameter of said engine and a speed of a vehicle in which said engine is mounted.

11. A method as set forth in claim 8, wherein said driving condition parameter of said engine is the intake air amount.

12. An apparatus for controlling a heater for heating an air-fuel ratio sensor provided in an exhaust gas flow passage of an internal combustion engine comprising:

means for detecting a driving condition parameter of said engine;

means for determining whether or not said parameter is larger than a predetermined value;

means for turning ON said heater when said parameter is not larger than said predetermined value;

means for turning OFF said heater when said parameter is larger than said predetermined value; and, means for delaying the turning ON of said heater with a predetermined delay time when said parameter is not larger than said predetermined value.

13. An apparatus as set forth in claim 12, further comprising of:

means for determining whether or not said engine is in a starting condition; and, means for decreasing said delay time immediately after said engine becomes in said starting condition.

14. An apparatus as set forth in claim 12, further comprising:

means for measuring a duration at which said heater is turned ON;

means for determining whether or not said duration is longer than the predetermined time period;

means for turning OFF said heater when said parameter is larger than said predetermined value and said duration is longer than said predetermined time period.

15. An apparatus as set forth in claim 12, further comprising:

means for changing said delay time in accordance with said driving condition parameter of said engine and a speed of a vehicle in which said engine is mounted.

16. An apparatus as set forth in claim 12, wherein said driving condition parameter of said engine is an intake air amount.

17. An apparatus as set forth in claim 13, wherein said delay time is 0.

18. An apparatus as set forth in claim 13, further comprising a means for judging whether or not an engine rotational speed is larger than a predetermined speed, thereby determining that said engine is in said starting condition.

19. An apparatus for controlling a heater for heating an air-fuel ratio sensor provided in an exhaust gas flow passage of an internal combustion engine comprising:

means for detecting a driving condition parameter of said engine;

means for determining whether or not said parameter is larger than a predetermined value;

means for turning ON said heater when said parameter is not larger than said predetermined value;

means for turning OFF said heater when said parameter is larger than said predetermined value; and, means for delaying the turning OFF of said heater with a predetermined delay time when said parameter is larger than said predetermined value.

20. An apparatus as set forth in claim 19, further comprising:

means for measuring a duration at which said heater is turned OFF;

means for determining whether or not said duration is longer than a predetermined time period;

means for turning ON said heater when said parameter is larger than said predetermined value and said duration is longer than said predetermined time period.

21. An apparatus as set forth in claim 19, further comprising:

means for changing said delay time in accordance with said driving condition parameter of said engine and a speed of a vehicle in which said engine is mounted.

22. An apparatus as set forth in claim 19, wherein said driving condition parameter of said engine is an intake air amount.

* * * * *